United States Patent [19]

Reichel

[11] Patent Number: 5,074,210

[45] Date of Patent: Dec. 24, 1991

[54] PLATE ATTACHMENT SYSTEM FOR A PRINTING MACHINE FORM CYLINDER

[75] Inventor: Klaus T. Reichel, Augsburg, Fed. Rep. of Germany

[73] Assignee: Man Roland Druckmaschinen AG, Offenbach am Main, Fed. Rep. of Germany

[21] Appl. No.: 661,468

[22] Filed: Feb. 26, 1991

[30] Foreign Application Priority Data

Apr. 10, 1990 [DE] Fed. Rep. of Germany ... 9004130[U]

[51] Int. Cl.[5] ..... B41F 1/28; B41F 21/00

[52] U.S. Cl. ..... 101/415.1; 51/364; 51/367; 51/368; 51/370; 101/379

[58] Field of Search ..... 101/415.1, 378; 51/364, 51/367, 368, 370

[56] References Cited

U.S. PATENT DOCUMENTS 4,495,865 1/1985 Kamoda ..... 101/415.1

FOREIGN PATENT DOCUMENTS 0330736 9/1989 European Pat. Off. .

2116570 11/1971 Fed. Rep. of Germany .

3339185 5/1985 Fed. Rep. of Germany .

*Primary Examiner*—Edgar S. Burr

*Assistant Examiner*—Moshe I. Cohen

*Attorney, Agent, or Firm*—Frishauf, Holtz, Goodman & Woodward

[57] ABSTRACT

To provide for circumferential support of a stretching spindle (8) having axially extending holding or stretching grooves (9, 10) to retain an end portion (14, 17) of a printing plate and clamp the other end portion (16) against the wall of an axially extending clamping groove, a resilient support element (11) is secured to the spindle, to bear against an inner wall of the clamping groove. Preferably, the support element is a resilient or springy element, secured to the spindle by a screw (12). The arrangement permits selective rotation of the form cylinder (1) in either direction, upon suitable placement of the printing plate thereover, with no change of parts or disassembly or reassembly being necessary, by merely rotating the spindle (8) in appropriate direction with respect to the direction of rotation of the form cylinder.

4 Claims, 1 Drawing Sheet

PLATE ATTACHMENT SYSTEM FOR A PRINTING MACHINE FORM CYLINDER

FIELD OF THE INVENTION

The present invention relates to printing machinery, and more particularly to attach, and preferably stretch, a cover, such as a printing plate, on a form cylinder of a printing machine.

BACKGROUND

Various systems are known to stretch a plate, such as a printing plate, on the form cylinder of a rotary printing machine, see for example German Patent DE 33 39 185; in this arrangement, the form cylinder has an axially extending cylinder groove cut therein, symmetrical with respect to a leading or trailing side, in which a clamping or stretching spindle is rotatably located. The spindle can rotate about its axis, and the groove is formed with an external slit so that the ends of the printing plate can be introduced through the slit, to be then clamped therein. One of the walls of the groove is formed with a support element, adapted to bear against the clamping spindle, in order to counteract bend-through of the spindle. Since form cylinders of such printing machines can operate in clockwise (CW) or counterclockwise (CCW) direction, the spindle support element is located, in accordance with the then used direction of rotation, at the right or at the left side of the clamping groove wall.

The spindle support element is secured to the wall of the groove, for example by an adhesive, or is otherwise attached thereto. Consequently, when the direction of rotation of the form cylinder is to be reversed, it is necessary to remove the form cylinder, and replace it with one in which the support element is at the other side of the groove wall. The fixed attachment of the spindle support is necessary to prevent unintended loosening of the support, which might fall out of the groove, and damage the printing machine. Simple reversal of rotation of the form cylinder, thus, is not possible in machines of this type.

THE INVENTION

It is an object to provide a clamping arrangement which is so constructed that the direction of rotation of the form cylinder can be changed, so that the versatility of the printing machine of which the form cylinder forms a part is enhanced, and, specifically, the arrangement should be suitable in a single-station printing machine, that is, the direction of rotation of the form cylinder should be freely selectable even after the form cylinder has been installed. Essentially, matching the construction of the clamping and stretching system to the selected direction of rotation of the form cylinder should be capable of being carried out simply and rapidly.

Briefly, a bend-through prevention arrangement is provided which is secured to the spindle itself, and located on the spindle so that it can be placed in engagement against a respective side wall of the groove. Preferably, this support element is located symmetrically with respect to clamping notches or clamping grooves formed in the spindle, so that it is only necessary to rotate the spindle such that the support element will engage either the right side or the left side of the clamping groove, in dependence on the selected direction of rotation of the form cylinder.

DRAWINGS

FIG. 1 is a schematic fractional radial section through a portion of a form cylinder, and illustrating the clamping and stretching system in accordance with the present invention, intended for clockwise rotation of the form cylinder, that is, rotation towards the right; and FIG. 2 illustrates the system of FIG. 1 for CCW or left rotating operation of the form cylinder.

DETAILED DESCRIPTION

Figure 1:
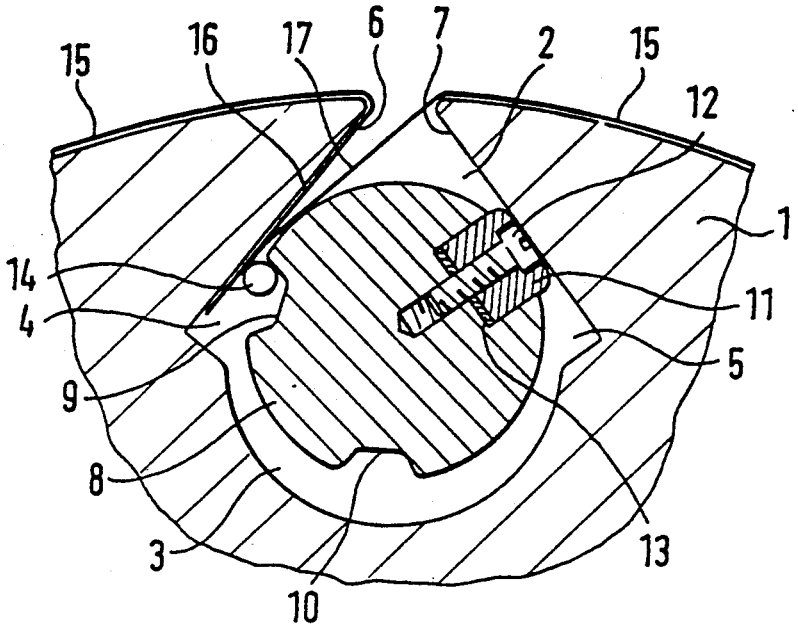

A form cylinder 1, shown only in fragmentary representation in FIG. 1, and is formed with an elongated, partly cylindrical groove 2. The cylindrical groove 2, essentially, is formed as a cylindrical bore 3 extending parallel to the axis of rotation of the form or plate cylinder 1. It has two slits 4, 5, symmetrical with respect to the opening of the cylindrical bore 3, and having side walls 6, 7 extending tangentially with respect to the bore 3. The walls 6, 7 and the slits 4, 5 are, at the same time, wall portions of the cylinder groove 2.

A stretching or clamping spindle 8 is located in the cylinder groove 2, rotatable about its axis. The clamping spindle 8 has two clamping or stretching grooves 9, 10 located at the circumference thereof, to receive one of the ends of a printing plate. The grooves 9, 10 are not located diametrically opposite each of each other on the spindle but, rather, a connecting line of the grooves would form a chord, defining a smaller and larger segmental area of the cross section of the spindle 8.

In accordance with a feature of the invention, a support element 11 is located on the circumference of the spindle 8 at the larger one of the segmental areas, with respect to the cross section of the spindle 8, and positioned symmetrically with respect to the grooves 9, 10. The support element 11, preferably, is formed as a resilient or springy element, secured by a screw 12 on the spindle body 8, and recessed within the resilient or yielding support element 11. The support element 11 can, for example, be formed by a plurality of stacked springs or the like. The screw 12 is ground or polished at its circumference, together with the spindle 8. Shims 13 of different sizes can be located beneath the yielding element 11 and the bottom of the recess in the spindle 8 in which the yielding element is located, in order to compensate for tolerances between the cylinder groove 2 and the yielding element 11. Thus, the extent of projection, or the thickness of the yielding element and its height, can be accurately adjusted.

Use and operation

To stretch a printing plate 15 on the form cylinder 1, a plate is used which has an end bead, for example in form of a wire 14, located thereon. One end portion 16 of the printing plate is sharply bent about itself, and hooked with its fold or bend into an upper edge of the cylinder groove 2. The trailing end portion 17 of the printing plate, that is, the end portion which includes the tensioning wire 14, is introduced in the cylinder groove after the printing plate 15 has been wrapped about the cylinder 1. Initially, spindle 8 is so rotated that one of the two grooves, in FIG. 1 groove 9, is located to face the opening of the cylinder groove 2. The spindle 8 is then so rotated that the rear edge 17 of the plate 15 is pulled into the cylinder groove. The spindle 8 then is continued to be rotated until the printing plate 15 is properly stretched about the form cylinder 1.

The selection of which one of the two stretching grooves 9 or 10 is placed in alignment with the opening in the cylinder groove 2, upon introduction of the plate end 17 of plate 15, and the direction of rotation of the spindle 8 to stretch the printing plate 15 depends on the direction of rotation of the form cylinder 1. FIG. 1 illustrates the spindle 8, with the printing plate 15 stretched thereover, with a form cylinder 1 rotated in right-left or. CCW rotation. The leading edge 16 of the printing plate 15 is hooked over the left upper edge of the cylinder groove, and the trailing edge 17 is hooked into the stretching groove 9 which, looked at from the support element 11, is at the left side thereof. To stretch the printing plate 15, spindle 8 is turned towards the left, that is, in CCW direction. This rotates the support element 11 against the wall 7 of the groove 2 and supports the spindle, counteracting any bend-through of the spindle.

Figure 2:
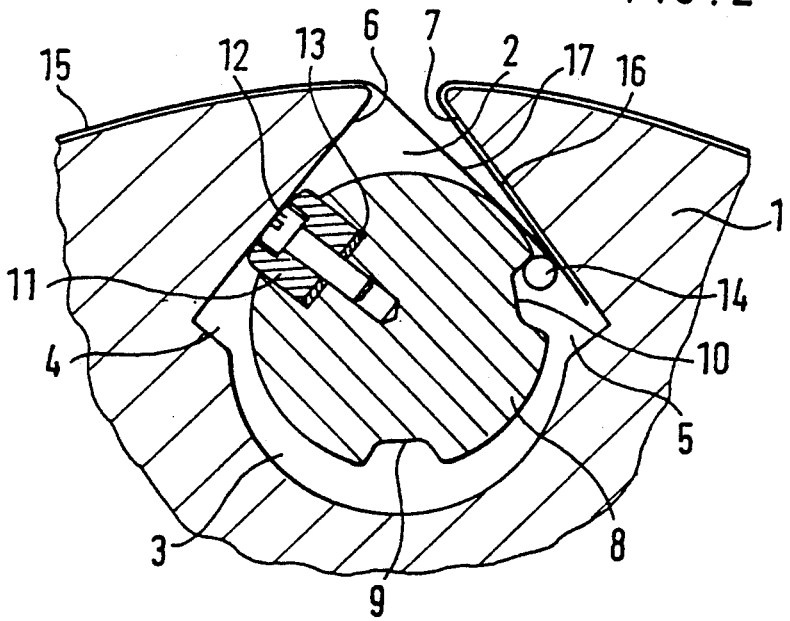

If the form cylinder rotates towards the right, as seen in FIG. 2, that is, in CW direction, the spindle 8 is rotated in CW direction. Since the clamping system of FIG. 2 is identical to that of FIG. 1—a substantial advantage in the present invention since the system is independent of the direction of rotation of the form cylinder—a further detailed description of the individual elements is not necessary. The reference numerals in FIGS. 1 and 2 are identical. The arrangement as illustrated in FIG. 2 differs from that shown in FIG. 1 only insofar as the leading edge 16 of the printing plate 15 is hooked in the right edge of the groove 2 and the trailing end 17 with the support wire 14 is hooked into the right stretching groove 10, and the spindle 8 is turned towards the right.

The system has the advantage that any printing plate 15 which has a portion or a device to assist in stretching the printing plate can be stretched on the form cylinder 1 regardless of the direction of rotation of the form cylinder. Such stretching accessories may, for example, be merely a bead or wire 14, or for example a plurality of stretching deformations, such as bumps, buttons or the like which can fit into the respective grooves 9, 10. If it is desired to change the direction of rotation of the form cylinder, it is only necessary to move the stretching spindle 8, upon first placing the printing plate 15 about the form cylinder, into the starting position in which the respective groove 9 or 10 faces the opening in the groove 2 of cylinder 1. No exchange of parts is necessary and, especially, the clamping system itself need not be removed from the cylinder and reassembled with a changed arrangement of parts thereof, and/or a support element. The system has the additional advantage that no parts can be lost or, in operation, can fall out or inadvertently become loose, so that the danger of damage to the apparatus and, more importantly, possible injury to operating personnel is effectively prevented.

Various changes and modifications may be made within the scope of the inventive concept.

What is claimed is:

1. Universal printing plate attachment system to stretch a printing plate (15) on a form cylinder (1) of a printing machine, and in which the form cylinder may rotate in either of two directions of rotation, said form cylinder (1) having a cylinder groove (2, 3) extending in axial direction, said groove having symmetrical side walls (6, 7);

a clamping spindle (8) rotatably received in said cylinder groove (2, 3) and formed with at least two axially extending stretching grooves (9, 10) for holding one end portion (17) of the printing plate and clamping the other end portion (16) against the groove of said wall, and means to prevent bend-through of the clamping spindle (8) upon engagement with the end portions of the printing plate, wherein, in accordance with the invention, said bend-through prevention means comprises a support element (11) secured to the spindle and placed for engagement against a respective side wall (6, 7) of the groove wherein said support element is located on the spindle circumferentially symmetrical with respect to said holding grooves.

2. The system of claim 1, wherein said at least two axially extending grooves comprises two holding grooves.

3. The system of claim 1, wherein said support element (11) comprises a resilient element (11).

4. The system of claim 2, wherein said support element (11) comprises a resilient element (11).

* * * * *